US006450350B1

(12) United States Patent
Krummell, Jr.

(10) Patent No.: US 6,450,350 B1
(45) Date of Patent: Sep. 17, 2002

(54) STORAGE RACK SYSTEM WITH FLARED END LOAD BEAM

(76) Inventor: John V. R. Krummell, Jr., 5702 Bolsa Ave., Huntington Beach, CA (US) 92649

( * ) Notice: Subject to any disclaimer, the term of this patent is extended or adjusted under 35 U.S.C. 154(b) by 0 days.

(21) Appl. No.: 09/591,903

(22) Filed: Jun. 12, 2000

(51) Int. Cl.[7] ..... A47B 47/00
(52) U.S. Cl. ..... 211/191; 211/183; 248/219.3
(58) Field of Search ..... 211/190–192, 186, 211/187, 189, 151, 162, 183; 312/321, 334.1, 334.7, 265.1; 248/228.1, 429, 157, 200.1, 214, 217.2, 218.4, 219.3

(56) References Cited

U.S. PATENT DOCUMENTS 3,349,924 A * 10/1967 Maurer et al. ..... 211/177
4,058,047 A * 11/1977 Kramer et al.
4,106,630 A * 8/1978 Rosenband ..... 211/191
4,549,665 A * 10/1985 Smitley ..... 211/191
4,778,067 A * 10/1988 Bellerose ..... 211/187
5,180,068 A * 1/1993 Vargo ..... 211/191
5,330,066 A * 7/1994 Carroll ..... 211/189
5,566,836 A * 10/1996 Lerman ..... 211/189
5,735,221 A * 4/1998 Benayon ..... 211/187
5,749,481 A * 5/1998 Miller ..... 211/191
5,761,786 A * 6/1998 Simons
5,777,826 A * 7/1998 Tsuchida et al.
6,061,989 A * 5/2000 Trivedi et al. ..... 248/200
6,085,918 A * 7/2000 Duff et al. ..... 211/191
6,123,154 A * 9/2000 MacDonald, III et al. .. 248/214
6,173,848 B1 * 1/2001 Bravo ..... 211/187

* cited by examiner

*Primary Examiner*—Gregory J. Strimbu
*Assistant Examiner*—Jennifer E. Novosad
(74) *Attorney, Agent, or Firm*—Lyon & Lyon LLP

(57) ABSTRACT

A storage rack has a spaced apart upright frames or vertical columns. Load beams extend between the upright frames. The load beams have flattened or flared ends, allowing the load beams to be directly bolted onto the vertical upright frames. The load beams may be made from standard steel channel sections, by flattening or flaring the ends in a press.

12 Claims, 2 Drawing Sheets

Fig. 2
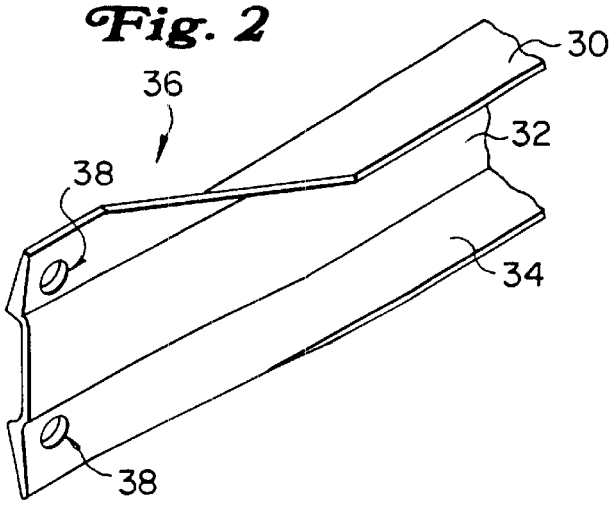
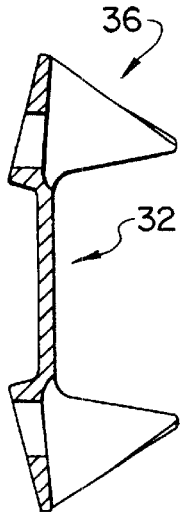
Fig. 4
Fig. 3
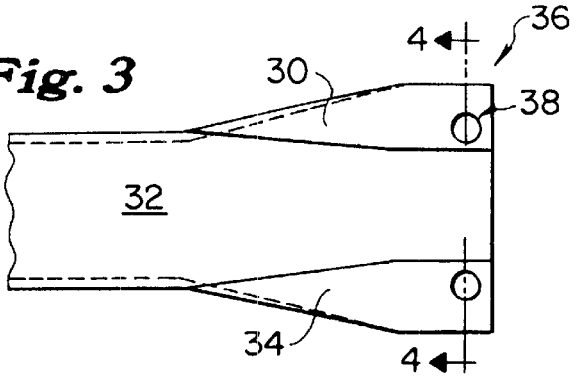
Fig. 5
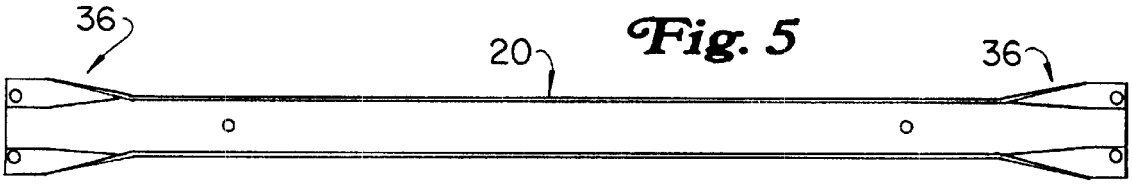
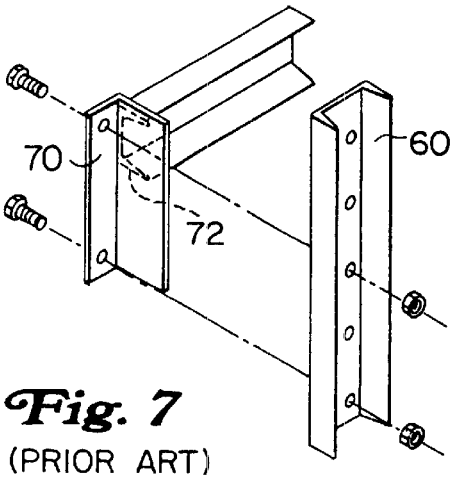
Fig. 7
(PRIOR ART)
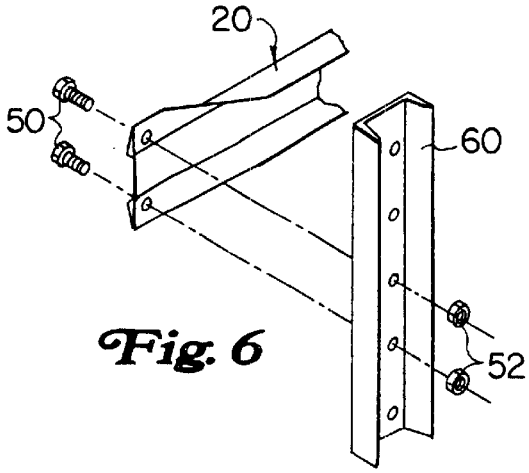
Fig. 6

STORAGE RACK SYSTEM WITH FLARED END LOAD BEAM

BACKGROUND OF THE INVENTION

The field of the invention is warehouse storage racks.

Storage racks are frequently used in warehouses and other storage locations. Storage racks allow materials and products to be stored easily, while still providing quick access, and while also maximizing effective use of available space. Many different styles of storage racks have been successfully used. Typically, a storage rack has upright frames which are supported on or attached to the floor of the warehouse or other location. Load beams are typically attached to the upright frames. Pallet supports or cart rails are attached to the load beams and/or the upright frames. Pallets carrying the goods or materials to be stored are typically placed onto the load beams.

For manufacturing efficiency, the upright frames, load beams, and pallet supports are often manufactured using standard steel channel sections. As the load beams must be attached perpendicularly to the upright frames, in the past, clips have been separately made and attached (e.g., welded) to the ends of the load beams, to attach the load beams to the upright frames, as shown in FIG. 7. While this design has worked well in the past, it requires separate manufacture of the end clips, which increases the cost of the storage rack components. In addition, the end clips can fail due to defects in the welds attaching the end clip to the load beam.

Accordingly, there remains a need for an improved storage rack.

SUMMARY OF THE INVENTION

To this end, in a first aspect of the invention, a storage rack has a pair of spaced upright frames. A load beam extends between the upright frames. The load beam advantageously has a channel section and flattened or flared ends. The flared ends have clearance holes, allowing the load beam to be bolted directly to the upright frames. Manufacturing efficiency is improved as fewer parts are needed. Reliability is improved as welding to manufacture the load beams is eliminated.

Other objects and advantages will appear hereinafter.

BRIEF DESCRIPTION OF THE DRAWINGS

In the drawings, wherein the same element number denotes the same element, throughout the several views:

FIG. 2 is a perspective view of one end of the load beam of the storage rack shown in FIG. 1;

FIG. 3 is a side elevation view thereof;

FIG. 4 is an enlarged section view taken along line A—A of FIG. 3;

FIG. 5 is a side elevation view of the load beam shown in FIG. 1;

FIG. 6 is a perspective view showing the attachment of the load beam shown in FIGS. 2–5 to the upright or upright frame shown in FIG. 1; and FIG. 7 is a perspective view of a prior art load beam.

DETAILED DESCRIPTION OF THE DRAWINGS

Figure 1:
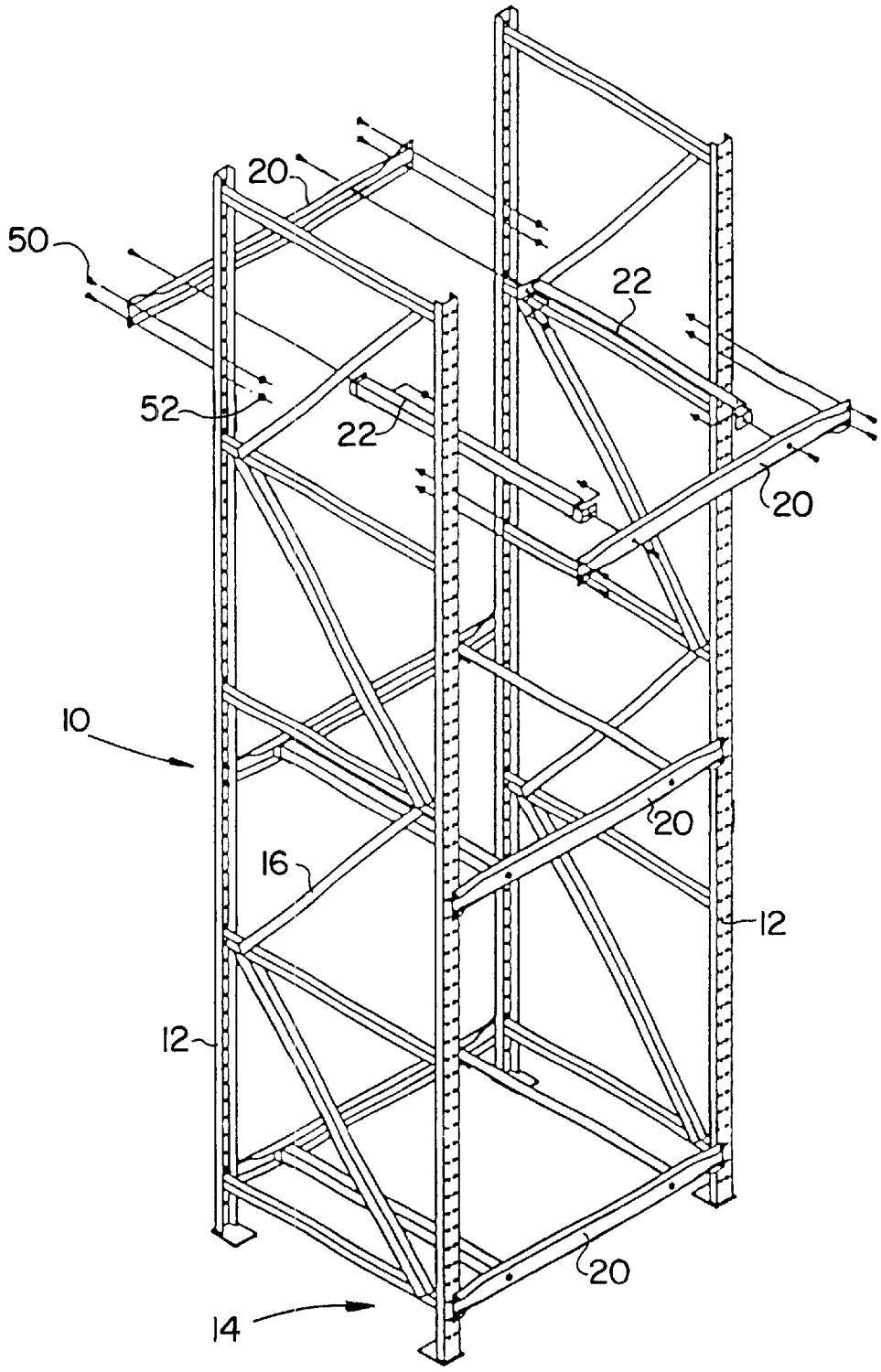
FIG. 1 is a perspective view of the new storage rack.

Turning now to the drawings, as shown in FIG. 1, a storage rack 10 has upright frames 12 supported on a floor 14, typically in a warehouse. Diagonal braces 16 or other stiffening members are attached to the upright frames 12. Horizontal load beams 20 are attached to the vertical upright frames 12. Pallet supports 22 may be attached to the load beam 20 and/or to the upright frames 12. Pallets may be placed on the load beams 20. Alternatively, rolling carts on rails may be used, as is well known in the industry. The design shown in FIG. 1 is illustrative of but one example of a storage rack. Various equivalent designs having different styles of braces, upright frames, load beams, and pallet supports, may of course be used.

Referring to FIGS. 2–5, the load beams 20 have a generally C-shaped channel section. The channel section is shown in phantom line in FIG. 4. The load beams 20 have a top leg 30 and a bottom leg 34 joined to a central web 32. The ends of the load beams 20 are flattened or flared. Clearance holes 38 pass through the flared ends 36 of the load beams 20.

As shown in FIG. 6, this allows the load beams 20 to be directly bolted onto an upright frame 12 or a vertical column 60, via bolts 50 passing through the clearance holes 38 and threaded into nuts 52 on the opposite side of the vertical column 60 or upright frame 12. Other attachment methods may also be used.

In contrast to the prior art design shown in FIG. 7, no separate clip 70 is needed, reducing the complexity and cost of the storage rack 10. In addition, the welded joint 72 between the clip 70 and load beam in the prior design, shown in FIG. 7, is eliminated, thereby improving the reliability of the storage rack, as failure due to cracking in weld joints is eliminated.

The load beams 20 are manufactured preferably using standard steel channel sections or shapes, such as the C-section beam shown in phantom in FIG. 4. The stock steel channel sections are cut to the desired length, as shown in FIG. 5. The ends of the load beam 20 are then placed into a press, to flatten or flair the ends, so that the inside surface of the top leg 30 and bottom leg 34 is generally parallel to the plane of the web 32, as shown in FIG. 4. The clearance holes 38 are then drilled or punched in the flared legs.

As shown in FIG. 6, the flared ends 36 allow the load beam 20 to be directly attached to the vertical member via two fasteners, which securely and reliably hold the load beam onto the vertical member. The fasteners pass through the load beam and vertical member perpendicularly to the plane of the web.

Thus, a novel storage rack has been shown and described. Various modifications may of course be made without departing from the spirit and scope of the invention. The invention, therefore, should not be limited, except to the following claims and their equivalents.

What is claimed is:

1. A warehouse storage rack comprising:

a pair of spaced apart upright frames fixed to a floor; and a load beam between and connecting to the upright frames, the load beam having a channel section extending between flattened flared ends of the load beam and with the load beam having generally horizontal upper and lower legs.

2. The storage rack of claim 1 wherein the channel section of the load beam has a generally C-shaped cross section.

3. The storage rack of claim 1 wherein the channel section of the load beam has an upper leg, a web joined to the upper leg, and a lower leg joined to the web, and a pair of mounting clearance holes.

4. The storage rack of claim 3 wherein the upper and lower legs are formed as a single piece with the web.

5. The storage rack of claim 1 further including a pair of pallet supports supported on one of the load beam and the upright frames.

6. The storage rack of claim 1 wherein the flattened flared ends of the load beam are attached to the upright frames via bolts.

7. The storage rack of claim 1 wherein the load beam is constructed from a steel channel section adapted for carrying pallets bearing heaving loads.

8. A warehouse storage rack comprising:

a plurality of spaced apart upright frames;

a pair of load beams connected to two of the plurality of upright frames, the load beams each having a channel section extending between flattened flared ends of the respective load beam, and with each load beam having generally horizontal upper and lower legs.

9. The storage rack of claim 8 wherein the channel section of each load beam has a generally C-shaped cross section.

10. The storage rack of claim 8 further including a plurality of pallet supports attached to the load beams.

11. The storage rack of claim 8 wherein each flattened flared end of each load beam is directly attached to an upright frame via at least one bolt.

12. A warehouse storage rack comprising:

a pair of spaced apart upright frames attached to a floor;

a load beam between and connecting to the upright frames, the load beam having flared ends and a channel section extending between the flared ends of the load beam, the load beam constructed from a steel channel section adapted for carrying pallets in a warehouse bearing heaving loads;

a pair of pallet supports on the load beam; and the load beam having an upper leg and a lower leg attached to a web section and with the web section oriented generally vertically and the upper and lower legs oriented generally horizontally.

* * * * *